US009206712B2

(12) United States Patent
Hayashida et al.

(10) Patent No.: US 9,206,712 B2
(45) **Date of Patent: *Dec. 8, 2015**

(54) VARIABLE VALVE TIMING DEVICE

(75) Inventors: Atsushi Hayashida, Aichi-ken (JP); Yuu Yokoyama, Okazaki (JP); Haruhito Fujimura, Toyota (JP)

(73) Assignee: Toyota Jidosha Kabushiki Kaisha, Toyota-shi, Aichi-ken (JP)

( * ) Notice: Subject to any disclaimer, the term of this patent is extended or adjusted under 35 U.S.C. 154(b) by 0 days.

This patent is subject to a terminal disclaimer.

(21) Appl. No.: 13/519,370

(22) PCT Filed: Apr. 7, 2011

(86) PCT No.: PCT/JP2011/058818

§ 371 (c)(1),
(2), (4) Date: Jun. 27, 2012

(87) PCT Pub. No.: WO2012/137336

PCT Pub. Date: Oct. 11, 2012

(65) Prior Publication Data

US 2014/0069359 A1 Mar. 13, 2014

(51) Int. Cl.
*F01L 1/34* (2006.01)
*F01L 1/344* (2006.01)

(52) U.S. Cl.
CPC ..... *F01L 1/34* (2013.01); *F01L 1/3442* (2013.01); *F01L 2001/34469* (2013.01); *F01L 2001/34476* (2013.01); *F01L 2250/02* (2013.01); *F01L 2800/00* (2013.01); *F01L 2800/14* (2013.01)

(58) Field of Classification Search
CPC . F01L 1/34; F01L 1/3442; F01L 2001/34476; F01L 2800/00; F01L 2800/14
USPC ..... 123/90.15, 90.17; 464/160
See application file for complete search history.

(56) References Cited

U.S. PATENT DOCUMENTS

| | | | | |
|---|---|---|---|---|
| 5,738,056 | A | 4/1998 | Mikame et al. | |
| 6,311,654 | B1 | 11/2001 | Ushida et al. | |
| 6,505,586 | B1 * | 1/2003 | Sato et al. | 123/90.17 |
| 7,100,554 | B2 * | 9/2006 | Hirowatari et al. | 123/90.17 |
| 8,297,245 | B2 * | 10/2012 | Urushihata | 123/90.17 |

(Continued)

FOREIGN PATENT DOCUMENTS

| | | |
|---|---|---|
| GB | 2 385 889 | 9/2003 |
| JP | 2001-41012 | 2/2001 |

(Continued)

OTHER PUBLICATIONS

Office Action for U.S. Appl. No. 13/257,484 dated Jul. 17, 2013.

(Continued)

*Primary Examiner* — Ching Chang
(74) *Attorney, Agent, or Firm* — Finnegan, Henderson, Farabow, Garrett & Dunner, LLP

(57) ABSTRACT

A variable valve timing device that allows a valve timing of an engine valve to be varied by relatively rotating a vane rotor and a housing. The variable valve timing includes a lock mechanism that releases the locking in accordance with the application of a lock releasing oil pressure. A crank angle CCA at which the application of the lock releasing oil pressure is instructed can be varied in accordance with an engine speed NE so that the lock releasing oil pressure rises at a crank angle in which cam torque is suitable for lock releasing.

2 Claims, 4 Drawing Sheets

(56) References Cited

U.S. PATENT DOCUMENTS

| | | | |
|---|---|---|---|
| 2005/0022763 | A1 | 2/2005 | Kobayashi et al. |
| 2005/0098131 | A1 | 5/2005 | Hirowatari et al. |
| 2005/0150473 | A1 | 7/2005 | Kobayashi et al. |
| 2009/0020085 | A1 | 1/2009 | Hattori |
| 2010/0269772 | A1 | 10/2010 | Takemura et al. |
| 2010/0305835 | A1 | 12/2010 | Inoue et al. |
| 2011/0030633 | A1 | 2/2011 | Urushihata |
| 2011/0162606 | A1 | 7/2011 | Kaneko |
| 2013/0118428 | A1 | 5/2013 | Suzuki et al. |
| 2013/0146005 | A1 | 6/2013 | Watanabe |

FOREIGN PATENT DOCUMENTS

| | | | | |
|---|---|---|---|---|
| JP | 2001-050064 | | | 2/2001 |
| JP | 2003-020916 | | | 1/2003 |
| JP | 2003-172110 | | | 6/2003 |
| JP | 2005-036789 | | | 2/2005 |
| JP | 2005-076518 | | | 3/2005 |
| JP | 2005-207431 | | | 8/2005 |
| JP | 2007153212 | A | * | 6/2007 |
| JP | 2007-255258 | | | 10/2007 |
| JP | 2009-24563 | | | 2/2009 |
| JP | 2009-024600 | | | 2/2009 |
| JP | 2009-024659 | | | 2/2009 |
| JP | 2010-209780 | | | 9/2010 |
| JP | 2010-223172 | | | 10/2010 |
| JP | 2010-275911 | | | 12/2010 |
| JP | 2011-038446 | | | 2/2011 |
| KR | 1997-0070418 | | | 11/1997 |
| KR | 2001-0030066 | | | 4/2001 |
| KR | 2004-0050307 | | | 6/2004 |
| WO | WO 2012/063312 | | | 5/2012 |

OTHER PUBLICATIONS

Office Action for U.S. Appl. No. 13/257,484 dated Dec. 26, 2013.
Notice of Allowance and Fee(s) Due for U.S. Appl. No. 13/257,484 dated Dec. 31, 2014.
Office Action for U.S. Appl. No. 14/115,493 dated Nov. 19, 2014.
Corrected Notice of Allowability for U.S. Appl. No. 13/257,484 dated Nov. 3, 2014.
Office Action for U.S. Appl. No. 14/115,493 dated Apr. 28, 2015.
Notice of Allowance and Fee(s) Due and Notice of Allowability for U.S. Appl. No. 14/115,493 dated Jul. 28, 2015.
Corrected Notice of Allowability for U.S. Appl. No. 14/115,493 dated Aug. 13, 2015.

* cited by examiner

High Engine Speed

Low Engine Speed

VARIABLE VALVE TIMING DEVICE

CROSS-REFERENCE TO RELATED APPLICATIONS

This application is a national phase application of International Application No. PCT/JP2011/058818, filed Apr. 7, 2011, the content of which is incorporated herein by reference.

FIELD OF THE INVENTION

The present invention relates to a variable valve timing device that varies a rotation phase of a camshaft by relatively rotating first and second rotation bodies and includes a lock mechanism that locks the first and second rotation bodies to rotate integrally and releases the locking in accordance with the application of a lock releasing oil pressure.

BACKGROUND OF THE INVENTION

A variable valve timing device is a known device applied to an internal combustion engine mounted on a vehicle or the like. The variable valve timing device changes the relative rotation phase of a camshaft with respect to a crankshaft, which is an engine output shaft, to vary the valve timing of engine valves (intake/exhaust valves). As such a variable valve timing device, an oil pressure type variable valve timing device operated by oil pressure such as that described in patent document 1 is known.

The structure of the variable valve timing device described in document 1 will now be described with reference to FIG. 3.

As shown in the drawings, a vane rotor 2, which includes a plurality of (three in the drawing) vanes 3 projecting outward in the radial direction, is fixed to a camshaft 1 so as to be rotatable integrally with the camshaft 1. A generally annular housing 4 is arranged outside the vane rotor 2 so as to be rotatable relative to the vane rotor 2. A cam sprocket 5, which is driven by and coupled to a crankshaft of an internal combustion engine with a chain, is fixed to the housing 4 to be rotatable integrally with the housing 4. Recesses 6, the number of which is the same as the vanes 3, are arranged inside the housing 4. One of the vanes 3 is arranged in each recess 6. The vane 3 accommodated in each recess 6 of the housing 4 defines two oil pressure chambers, namely a retardation chamber 7 and an advancement chamber 8. The retardation chamber 7 is located at the front side of the vane 3 in the rotation direction of the camshaft, and the advancement chamber 8 is located at the rear side of the vane 3 in the rotation direction of the camshaft.

The variable valve timing device includes a lock mechanism that locks the vane rotor 2 and the housing 4 so that the vane rotor 2 and the housing 4 rotate integrally. The lock mechanism includes a lock pin 10, which is movably arranged in a pin hole 9 formed in one of the vanes 3 of the vane rotor 2, and a lock hole 11, which is formed in the cam sprocket 5 and in which the lock pin 10 can be fit. A spring 12 urges the lock pin 10 in a direction in which the lock pin 10 is fitted to the lock hole 11. In a relative rotation range of the vane rotor 2 with respect to the housing 4, the lock pin 10 is located at a position in which it can be fitted to the lock hole 11 when the vane rotor 2 is relatively rotated to a farthest position in a direction opposite to the camshaft rotation direction (hereafter, referred to as most retarded position).

The variable valve timing device includes an oil pressure circuit that adjusts oil pressure to operate the variable valve timing device. In the oil pressure circuit, an oil pump 14, which draws oil from an oil pan 13 and discharges the oil, is connected by an supply oil passage 15 to an oil control valve (hereafter, referred to as the OCV 16). The OCV 16, which is formed as an electromagnetic drive valve controlled by an electronic control unit (hereafter, referred to as the ECU 20) that controls the engine, is connected to a drain oil passage 17, which returns oil to the oil pan 13, a retardation oil passage 18, which is connected to each retardation oil chamber 7, and an advancement oil passage 19, which is connected to each advancement oil chamber 8, in addition to the supply oil passage 15. The OCV 16 switches the one of the supply oil passage 15 and drain oil passage 17 that is connected to each of the retardation oil passage 18 and advancement oil passage 19 so that oil is supplied to or discharged from the retardation oil chambers 7 and the advancement oil chambers 8.

The oil pressure supplied to the retardation oil chambers 7 and the advancement oil chambers 8 acts on the lock pin 10. The oil pressure acts to remove the lock pin 10 from the lock hole 11 against the urging force of the spring 12.

The operation of the variable valve timing device will now be described.

The ECU 20, which serves as a control unit, instructs the OCV 16 to connect the supply oil passage 15 and the advancement oil passage 19 and to connect the drain oil passage 17 and the retardation oil passage 18. This increases the oil pressure in the advancement oil chambers 8 and decreases the oil pressure in the retardation oil chambers 7. The oil pressure chamber difference between the two oil chambers applies force to the vanes 3 that is directed in the rotation direction of the camshaft (hereafter, referred to as the advancement direction). This relatively rotates the vane rotor 2 with respect to the housing 4 in the advancement direction. As a result, the rotation phase of the camshaft 1, which is fixed to the vane rotor 2 in an integrally rotatable manner, is advanced from the rotation phase of the cam sprocket 5. This advances the valve timing of the engine valves, which are opened and closed by the camshaft 1.

When the ECU 20 instructs the OCV 16 to connect the supply oil passage 15 and the retardation oil passage 18 and to connect the drain oil passage 17 and the advancement oil passage 19, the oil pressure in the retardation oil chambers 7 increases and the oil pressure in the advancement oil chambers 8 decreases. The oil pressure chamber difference between the two oil chambers applies force to the vanes 3 that is directed in the direction opposite to the camshaft rotation direction (hereafter, referred to as the retardation direction). This relatively rotates the vane rotor 2 with respect to the housing 4 in the retardation direction. As a result, the rotation phase of the camshaft 1, which is fixed to the vane rotor 2 in an integrally rotatable manner, is retarded from the rotation phase of the cam sprocket 5. This retards the valve timing of the engine valves, which are opened and closed by the camshaft 1.

When the ECU 20 instructs the OCV 16 to stop the supply and discharge of oil for both of the retardation oil passage 18 and the advancement oil passage 19, the vane rotor 2 stops at a position at where the oil pressures in the retardation oil chambers 7 and the advancement oil chambers 8 is balanced. Thus, the present valve timing of the engine valves is kept constant.

When the engine is started, the vane rotor 2 is located at the most retarded position. Due to the lock pin 10 fitted to the lock hole 11, the vane rotor 2 is locked to rotate integrally with the housing 4 at the most retarded position.

When the discharge pressure of the oil pump 14 is sufficiently increased after the engine is started, the ECU 20 instructs the OCV 16 to connect the supply oil passage 15 and the advancement oil passage 19 to supply oil pressure to the advancement oil chambers 8. The oil pressure supplied to the advancement oil chambers 8 also acts on the lock pin 10, and the oil pressure removes the lock pin 10 from the lock hole 11. This releases the locking of the lock mechanism and permits relative rotation of the vane rotor 2 and the housing 4. In this manner, after the starting of the engine, an instruction issued by the ECU 20 when initially supplying oil pressure to the advancement oil chambers 8 instructs the application of a lock releasing oil pressure to release the locking of the lock mechanism.

PRIOR ART DOCUMENT

Patent Document

Patent Document 1: Japanese Laid-Open Patent Publication No. 2001-041012

SUMMARY OF THE INVENTION

The cam torque of the camshaft 1 acts on the vane rotor 2 of the variable valve timing device. More specifically, when an engine valve opens, a cam of the camshaft 1 has to force the engine valve downward against a valve spring that urges the engine valve in a closing direction. Thus, torque in a direction opposite to the camshaft rotation direction, namely, the retardation direction, acts on the camshaft 1 and the vane rotor 2, which is fixed to the camshaft 1 in an integrally rotatable manner. When an engine valve closes, the valve spring pushes the cam. Thus, torque acts on the camshaft 1 and the vane rotor 2 in the camshaft rotation direction, namely the advancement direction. As a result, torque in the advancement direction and torque in the retardation direction alternately act on the vane rotor 2 as the camshaft 1 drives and opens and closes the engine valves.

The cam torque affects the releasing performance of the lock mechanism in one way or another. More specifically, before releasing the lock, slight rotation of the vane rotor 2 is permitted within a range of play of the lock mechanism. Thus, the vane rotor 2 may be moved by the cam torque. Here, when removing the lock pin 10 from the lock hole 11 in the state shown in FIG. 4(*a*), rotation of the vane rotor 2 in the advancement direction as shown in FIG. 4(*b*) would result in the lock pin 10 being caught by an advancement side edge B of the lock hole 11 as shown in FIG. 4(*c*). Thus, the lock pin 10 may become irremovable. This may delay the permission of relative rotation between the vane rotor 2 and the housing 4 and the starting of the variable valve timing control of the engine valves.

When locking is performed at a position other than the most retarded position, the releasing performance is affected in the same manner by the state of the cam torque during the lock releasing. Thus, such a problem also occurs in the same manner in a variable valve timing device that performs locking at a position other than the most retarded position.

Accordingly, it is an object of the present invention to provide a variable valve timing device that ensures lock releasing.

To achieve the above object, in the present invention, a variable valve timing device allows a valve timing of an engine valve to be varied by relatively rotating first and second rotation bodies and includes a lock mechanism, which locks the first and second rotation bodies to rotate integrally and releases the locking in accordance with the application of a lock releasing oil pressure. A crank angle at which the application of the lock releasing oil pressure is instructed can be varied in accordance with an engine speed.

As described above, the easiness for releasing the lock changes in accordance with state of the cam torque when the lock is released. Accordingly, to ensure lock releasing, it is preferable that the lock releasing be performed at a crank angle at which the cam torque would be in a satisfactory state for the lock releasing.

Even when the application of a lock releasing oil pressure is instructed, there would be a constant delay until the lock releasing oil pressure actually rises and the lock releasing starts. Even if the delay time were to be constant from when such an instruction is issued to when the lock releasing oil pressure rises, a change in the present engine speed would change the varied amount of the crank angle from when the instruction is issued to when the lock releasing oil pressure rises. Accordingly, even if an instruction for the application of the lock releasing oil pressure were to be issued at a certain crank angle, a different engine speed would vary the crank angle when the lock releasing oil pressure rises and the lock releasing starts.

In this regard, in the present invention, the crank angle at which the application of the lock releasing oil pressure is instructed can be varied in accordance with the present engine speed. Thus, even when the engine speed changes, the crank angle at which the application of the lock releasing oil pressure is instructed can be set so that lock releasing is started at a crank angle in which the cam torque is in a state suitable for the lock releasing. Accordingly, the present invention further ensures lock releasing.

DETAILED DESCRIPTION OF THE PREFERRED EMBODIMENTS

Figure 1:
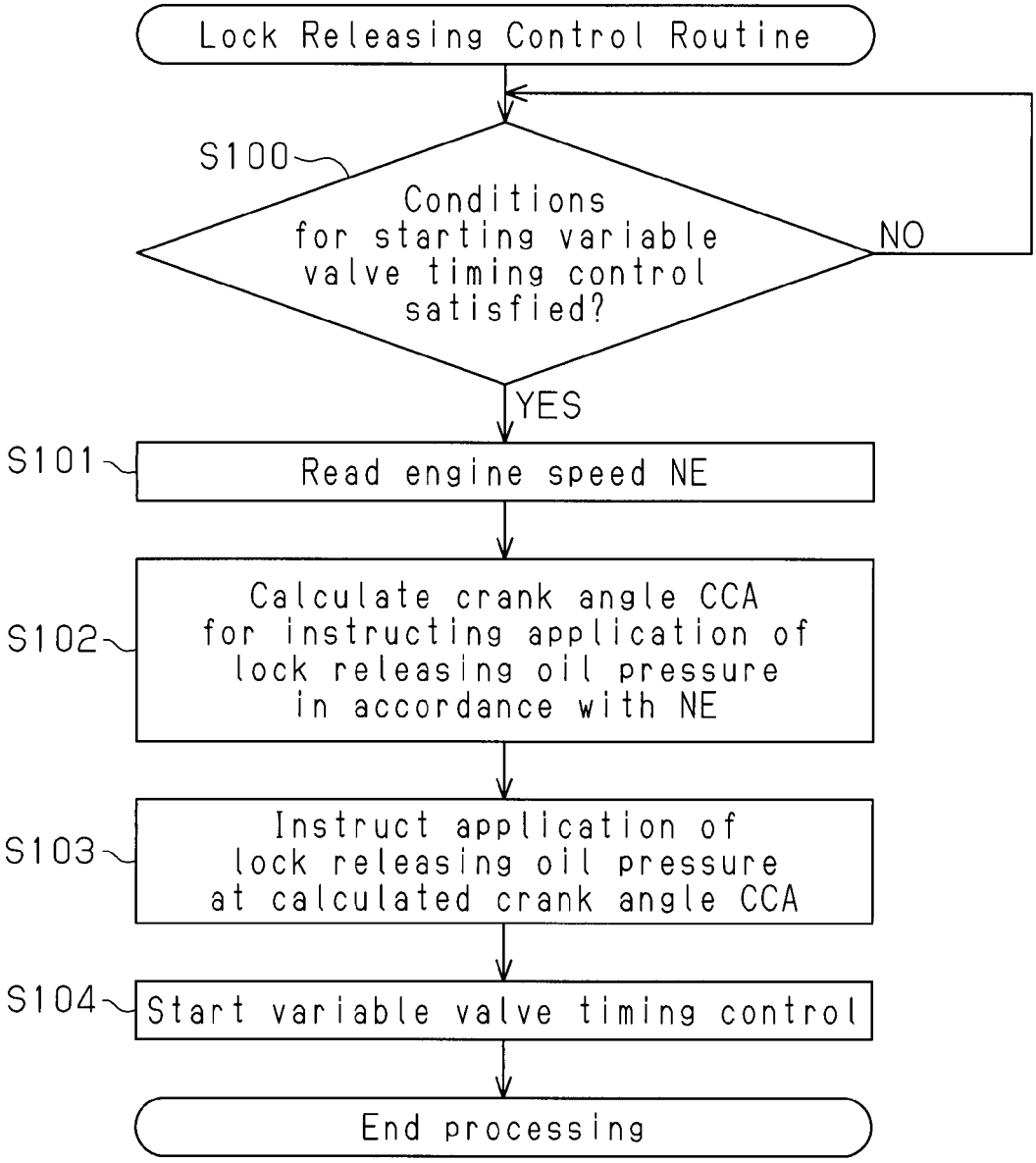
FIG. 1 is a flowchart of a lock releasing control routine in one embodiment of the present invention.

One embodiment of a variable valve timing device will now be described in detail with reference to FIGS. 1 and 2. The variable valve timing device of the present invention allows for the valve timing of intake valves to be varied and basically has the same structure as the variable valve timing device shown in FIG. 3. That is, the variable valve timing device of the present embodiment varies the valve timing of the intake valves by relatively rotating the vane rotor 2, which serves as a first rotation body, and the housing 4, which serves as a second rotation body. Further, the variable valve timing device includes the lock mechanism that locks the vane rotor 2 and the housing 4 so that the two rotate integrally and releases the locking in accordance with the application of a lock releasing oil pressure.

The ECU 20 for the variable valve timing device of the present embodiment controls the OCV 16 by performing duty control. More specifically, the ECU 20 instructs the OCV 16 of a duty instruction value DUTY, which takes a value in the range of −100% to +100%, to control the operation of the OCV 16. The OCV 16 supplies oil to the advancement oil chambers 8 when the duty instruction value DUTY is a positive value and supplies oil to the retardation oil chambers 7 when the duty instruction value DUTY is a negative value. The amount of oil supplied to the oil chambers increases as the absolute value of the duty instruction value DUTY increases.

When the engine stops, the ECU 20 rotates the vane rotor 2 to the most retarded position and fits the lock pin 10 into the lock hole 11 to lock the relative rotation of the vane rotor 2 and the housing 4. Accordingly, when the engine starts, the vane rotor 2 is located at the most retarded position, and the lock mechanism is in a locking state.

When the discharge pressure of the oil pump 14 is sufficiently increased after the engine is started, the ECU 20 instructs the OCV 16 of a 100% duty instruction value and supplies oil to the advancement oil passage 19 to apply the lock releasing oil pressure to the lock pin 10. This releases the locking of the lock mechanism.

As described above, the lock releasing performance changes as the state of the cam torque changes when the lock releasing starts. The cam torque changes in synchronism with the crank angle. Thus, to ensure lock releasing, the lock releasing is required to be started at a crank angle at which the cam torque is suitable for the lock releasing.

Even when the ECU 20 sends a duty instruction value of 100% to the OCV 16 and instructs the application of a lock releasing oil pressure, due to a delay in the OCV 16 or oil pressure system, there would be a constant delay until the lock releasing oil pressure actually rises. Even if the delay time were to be constant, a change in the present engine speed would change the varied amount of the crank angle from when the instruction is issued to when the lock releasing oil pressure rises. More specifically, the varied amount of the crank angle increases in proportion to the engine speed. Accordingly, even if an instruction for the application of the lock releasing oil pressure were to be issued at a certain crank angle, a different engine speed would vary the crank angle at which the lock releasing oil pressure actually rises.

In this regard, the ECU 20 allows the crank angle at which the application of the lock releasing oil pressure is instructed to be varied in accordance with the present engine speed. Thus, even when the engine speed changes, the lock releasing oil pressure is raised at a crank angle that is suitable for the lock releasing.

When it is desirable that the crank angle at which the lock releasing oil pressure rises be constant, the crank angle at which the application of the lock releasing oil pressure is instructed may be advanced in proportion to the engine speed. For example, equation (1) can be obtained when TCA [° CA] represents the crank angle at which the cam torque is suitable for lock releasing, DELAY [sec] represents the delay time from when the instruction for applying the lock releasing oil pressure is issued to when the lock releasing oil pressure rises, NE [rpm] represents the engine speed, and CCA [° CA] represents the crank angle at which the application of the lock releasing oil pressure can be instructed so that the lock releasing oil pressure can be raised at the crank angle TCA.

$$CCA = TCA - 60 \times \mathrm{DELAY} \times NE \quad (1)$$

FIG. 1 is a flowchart of a lock releasing control routine applied to the present embodiment. The ECU 20 processes this routine after the engine starts.

When this routine starts, in step S100, it is determined whether conditions for starting variable valve timing control, such as sufficient increasing of the discharge oil pressure of the oil pump 14, are satisfied. When the starting conditions are satisfied (S100: YES), in step S101, the present engine speed NE is read.

Then, in step S102, the crank angle CCA at which the application of the lock releasing oil pressure is applied is calculated in accordance with the read engine speed NE. The crank angle CCA is calculated using a computation map stored in the ECU 20 and indicating the corresponding relationship of the engine speed NE and the crank angle CCA.

Next, in step S103, the OCV 16 is instructed to apply the lock releasing oil pressure at the calculated crank angle CCA, and the variable valve timing control is started in accordance with the engine operation state resulting from the lock releasing (S104).

Figure 2A:
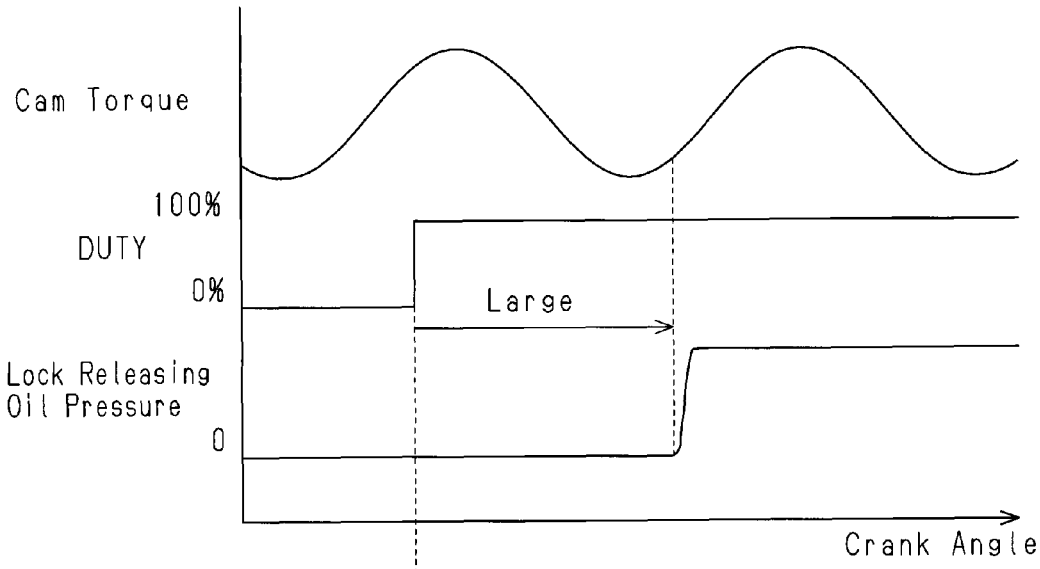
FIG. 2(*a*) is a time chart showing lock releasing control when the engine speed is high, and FIG. 2(*b*) is a time chart showing the lock releasing control when the engine speed is low.
Figure 2B:
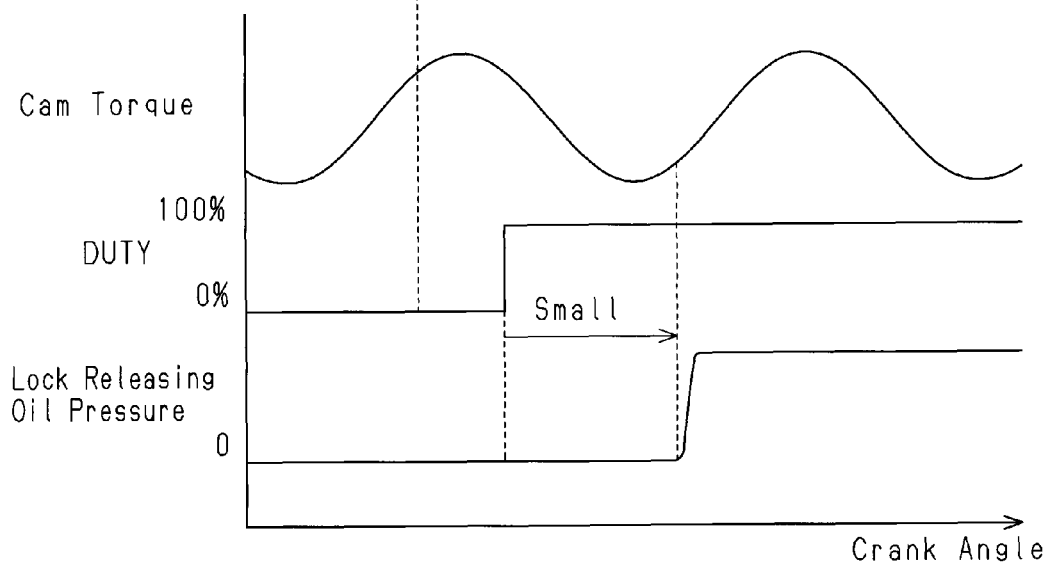
Figure 3:
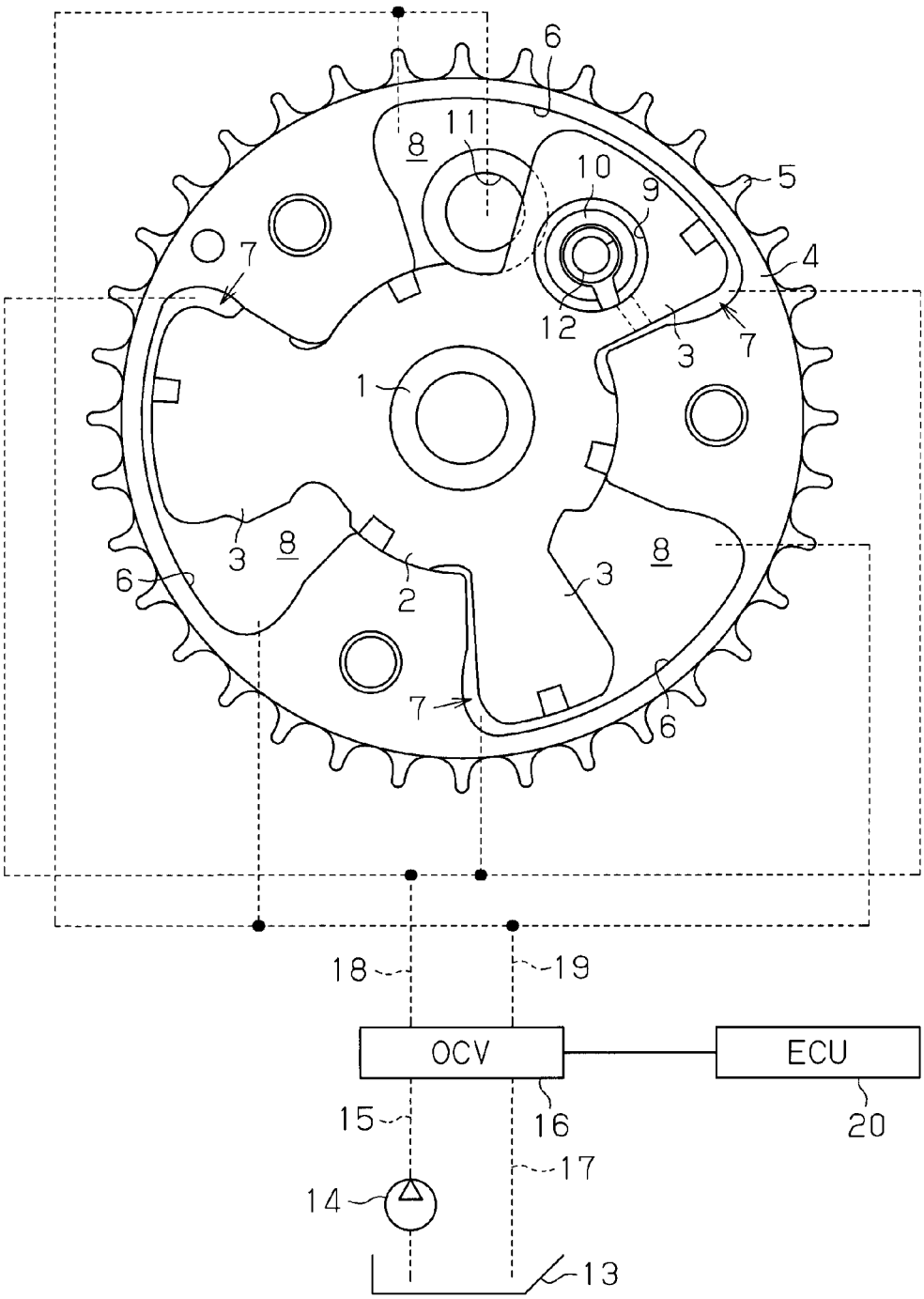
FIG. 3 is a schematic diagram showing the structure of a variable valve timing device.
Figure 4A:
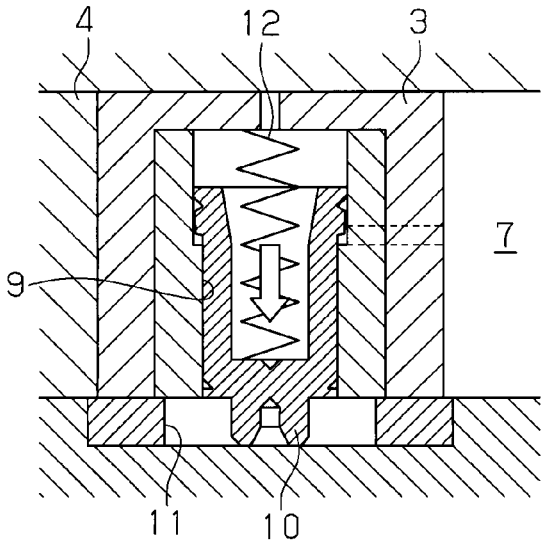
FIGS. 4(*a*) to 4(*c*) are cross-sectional views showing the transition of the lock mechanism when a releasing failure Occurs.
Figure 4B:
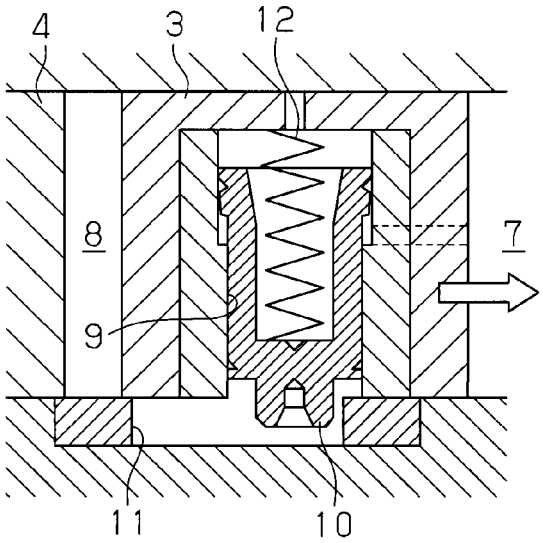
Figure 4C:
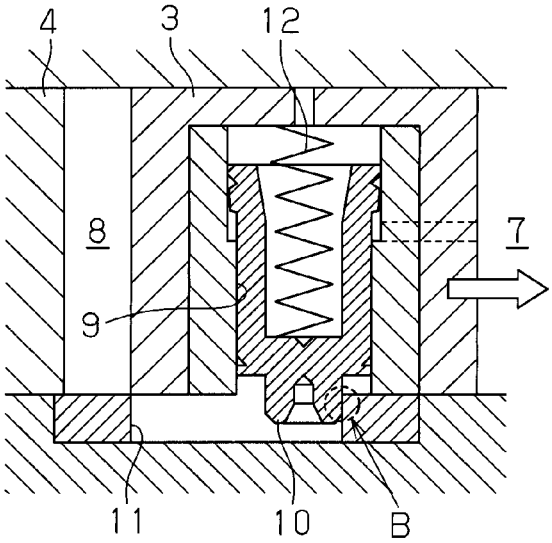

In the present embodiment, as shown in FIG. 2, a 100% duty instruction value is output to instruct application of the lock releasing oil pressure at a more advanced crank angle when the engine speed NE is high compared to when the engine speed NE is low. As a result, the crank angle at which the lock releasing oil pressure rises becomes substantially the same at any engine speed, and lock releasing is started in a state in which the cam torque is suitable for lock releasing.

The present embodiment has the advantages described below.

(1) In the present embodiment, the crank angle CCA at which the application of the lock releasing oil pressure is instructed can be varied in accordance with the engine speed NE. Thus, even when the engine speed NE changes, the crank angle CCA at which the application of the lock releasing oil pressure is instructed can be set so that lock releasing is started at a crank angle in which the cam torque is in a state suitable for the lock releasing. Accordingly, the present invention further ensures lock releasing.

The present embodiment described above may be modified in the following manner.

In the above embodiment, the crank angle at which the application of the lock releasing oil pressure is instructed is set in a variable manner in accordance with the engine speed so that the lock releasing oil pressure rises at a substantially constant crank angle regardless of the engine speed. When the crank angle is in a certain range that is suitable for lock releasing, the crank angle at which the application of the lock releasing oil pressure is instructed can be set so that the crank angle at which the lock releasing oil pressure rises is within the range.

When there is a plurality of crank angles suitable for lock releasing, the crank angle at which the application of the lock releasing oil pressure is instructed can be set so that the lock releasing oil pressure rises at one of the crank angles. For example, among the plurality of crank angles suitable for the lock releasing, the crank angle at which the application of the lock releasing oil pressure is applied may be set so that the lock releasing oil pressure rises at an earliest-reached crank angle after the starting conditions of the variable valve timing control are satisfied.

In the above embodiment, the lock mechanism is formed to perform locking when the vane rotor 2 is located at the most retarded position. However, the present invention may be applied in the same manner to a variable valve timing device including a lock mechanism formed to perform locking at a position other than the most retarded position.

The structure of the variable valve timing device, such as the number of the vanes 3, is not limited to that of the above embodiment and may be modified when necessary. The present invention can be applied as long as the rotation phase of the cam shaft can be varied by relatively rotating the first and second rotation bodies and a lock mechanism performs locking by integrally rotating the rotation bodies and releasing the locking by applying a lock releasing oil pressure.

In the above embodiment, the variable valve timing device is formed to allow for the valve timing of the intake valves to be varied. However, the present invention can be applied in the same manner to a device that allows the valve timing of exhaust valves to be varied.

DESCRIPTION OF REFERENCE CHARACTERS

1: cam shaft, 2: vane rotor (first rotation body), 3: vane, 4: housing (second rotation body), 5: cam sprocket, 6: recess, 7: retardation oil chamber, 8: advancement oil chamber, 9: pin hole, 10: lock pin (lock mechanism), 11: lock hole (lock mechanism), 12: spring (lock mechanism), 13: oil pan, 14: oil pump, 15: supply oil passage, 16: OCV, 17: drain oil passage, 18: retardation oil passage, 19: advancement oil passage, 20: ECU.

The invention claimed is:

1. A variable valve timing device that allows a valve timing of an engine valve to be varied, comprising:

first and second rotation bodies configured to rotate relative to each other to vary the valve timing;

a lock mechanism, which locks the first and second rotation bodies to rotate integrally and releases the locking in accordance with the application of a lock releasing oil pressure;

an oil control valve that is configured to apply the lock releasing oil pressure to the lock mechanism; and an electronic control unit programmed to instruct the oil control valve to apply the lock releasing oil pressure and determine timing of the instruction for the application of the lock releasing oil pressure based on a crank angle, the crank angle at which the application of the lock releasing oil pressure is instructed being set variably in accordance with an engine speed to compensate for a change in a varied amount of the crank angle from when the instruction is issue to when the lock releasing oil pressure actually rises.

2. The variable valve timing device according to claim 1, wherein the electronic control unit is programmed to advance the crank angle at which the application of the lock releasing oil pressure is instructed when the engine speed is high in comparison to a case where the engine speed is low.

* * * * *